United States Patent [19]

York

[11] 4,388,484

[45] Jun. 14, 1983

[54] OIL FIELD MATS

[76] Inventor: Gerald O. York, 623 Gardner St., Borger, Tex. 79007

[21] Appl. No.: 307,794

[22] Filed: Oct. 2, 1981

[51] Int. Cl.[3] ..... H01B 17/64

[52] U.S. Cl. ..... 174/5 R; 15/238; 238/14; 428/179; 428/256

[58] Field of Search ..... 174/5 R, 5 SB, 5 SG; 15/238; 238/14; 524/567, 496, 484, 68, 62; 428/179, 256

[56] References Cited

U.S. PATENT DOCUMENTS

| | | | |
|---|---|---|---|
| 3,640,459 | 2/1972 | Preisler | 238/14 |
| 3,645,934 | 2/1972 | Caywood, Jr. | 524/496 |
| 3,755,231 | 8/1973 | Muir et al. | 524/68 |
| 4,037,009 | 7/1977 | Severinsen | 428/256 |
| 4,162,999 | 7/1979 | Bohemen | 524/484 |
| 4,262,048 | 4/1981 | Mitchell | 428/179 |

FOREIGN PATENT DOCUMENTS

| | | | |
|---|---|---|---|
| 37461 | 5/1955 | Poland | 174/5 SB |
| 1054 | of 1903 | United Kingdom | 174/5 R |

*Primary Examiner*—William R. Dixon, Jr.
*Attorney, Agent, or Firm*—Ely Silverman

[57] ABSTRACT

Oil-resistant resilient mats to protect oil field workers from dangerous, high voltage electrical discharge comprise a first oil-resistant flexible resilient elastomer of extremely high dielectric strength which is usable by itself as a mat and also in combination with other oil-resistant elastomers of higher mechanical strength but less dielectric strength at high voltages and with metallic electrically conductive meshes to equalize mechanical and electrical stress across the first elastomer.

The combination of metallic mesh and elastomer of high electrical resistance at high voltage provides mechanically strong and oil resistant mats that protect personnel in oil fields against high voltage and surges. The high mechanical strength elastomer layers mechanically protect the conductive wire mesh as well as the first elastomer.

8 Claims, 5 Drawing Figures

FIG. 1
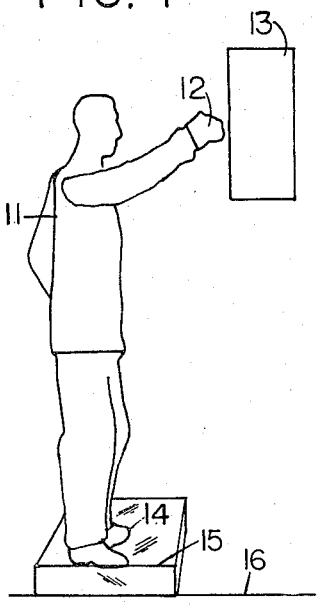
FIG. 2
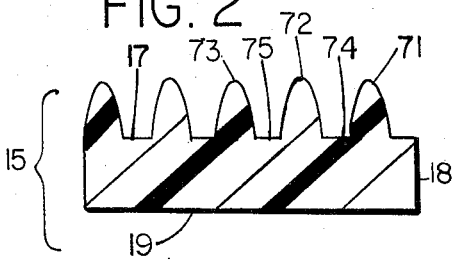
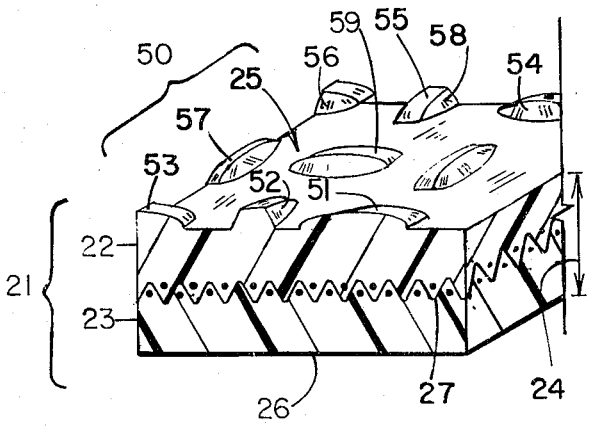
FIG. 3
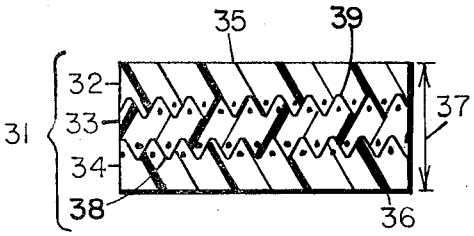
FIG. 4
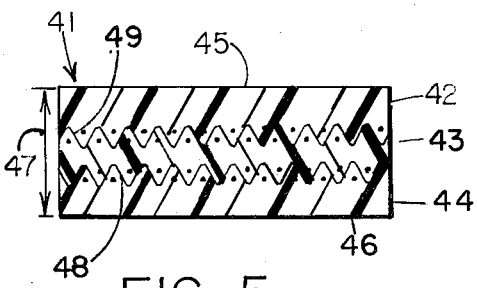
FIG. 5

OIL FIELD MATS

BACKGROUND OF THE INVENTION

The field of the invention is electrical protective equipment for use in oil fields.

DESCRIPTION OF THE PRIOR ART

Mats of the prior art have not been able to satisfactorily withstand the combination of mechanical wear and exposure to air and oils contacted on a drilling rig and also provide reliable electrical insulation to oil field workers. While solvent-resistant rubbers are known each of these have limitations as to other chemical and/or physical characteristics so that they do not have the combination of mechanical and electrical characteristics necessary for service as a protective insulating mat in the oil field where high electrical voltage, oil, and wear are met; for instance, fluoro-carbon rubbers and nitrile-butadiene and acrylate rubbers, which have good oil resistance, have poor electrical resistance at high voltage.

SUMMARY OF THE INVENTION

Abrasion-resistant and electrically insulating mats to reliably electrically protect operators in oil fields from high voltage containing apparatuses contacted by them are provided by an oil-resistant synthetic rubber which has extremely high dielectric properties at high voltage and which is used as a single layer oil field mat as well as in firm contact and in combinations with oil resistant tough surface materials that are more electrically conductive and mechanically reinforcing and serve to equalize mechanical and voltage stress across the high dielectric synthetic rubber.

BRIEF DESCRIPTION OF THE DRAWINGS

FIG. 1 is a side view of a operator standing on a mat 15, according to this invention and operating on an instrument panel.

FIG. 2 is a diagrammatic vertical cross section view of one embodiment of mat, 15, of FIG. 1.

FIG. 3 is a diagrammatic vertical cross section view of another embodiment, 21, of mat according to the invention with its upper surface shown in perspective.

FIG. 4 is a diagrammatic vertical cross section view of yet another embodiment, 31, of mat according to this invention.

FIG. 5 is a diagrammatic vertical cross sectional view of still another embodiment, 41, of mat according to this invention.

DESCRIPTION OF THE PREFERRED EMBODIMENTS

The use of the embodiments of this invention is diagramatically shown in FIG. 1 where an operator 11 extends his (or her) hand 12 to operate components of an instrument panel or box 13. The feet of the operator 14 are supported on the mat 15 (or 21 or 31 or 41) which is an abrasion-resistant, oil-resistant mat of high electrical resistance located between the feet 14 of the operator and a support surface, 16, such as the ground or other usual operator support such as a steel framework or platform located above the ground.

In usual operation of an oil rig using mats as 15, 21, 31, or 41 disclosed herewith an operator works on or with and contacts the instrument panyel or control box 13 through which electrical power passes to operate the electrical equipment for an oil well rig. The electrical power input to such box as 13, which usually contains silicon controlled rectifier type equipment, usually is at about 13 thousand volts.

EMBODIMENT OF FIG. 2

Mat 15 is a homogeneous imperforate, flexible, resilient molded elastomer mass 18 inches wide, 7/16 inches (1.11 cm) total height or thickness and, 36½ inches (92.7 cm) long; it is abrasion resistant and also oil resistant and has the formulation composition and characteristics set out in Table I. The upper flat surface 17 of the mat 15 is separated from the bottom surface of the mat 19 by a vertical minimum thickness of the mat 18. The bottom surface 19 of the mat is on the support or ground, the top surface 17 of the mat supports ridges as 71–73 contacted by the operator's feet.

The mat 15 is not substantially affected by the liquids or mixes of liquids and grit found in the vicinity of oil well rigs and also maintains its electrical resistivity. At the same time it is flexible enough to absorb shocks and may be bent at 70° F. (21° C.) so that different portions of the top surface 17 face each other with only a radius of curvature of ½ inch (12.7 mm.) and without developing cracks.

The entire upper surface 17 of mat 15 is provided with uniformly spaced and sized parallel ridges 71, 72 and 73 and grooves as 74 and 75 therebetween to improve traction with operators' shoes. In the preferred embodiment 15 the ridges are ¼ inch (0.64 cm) high over the floor of the grooves between the ridges, and the ridges are ⅛ inch (0.32 cm) wide at their top and the lengths of the ridges are arrayed in parallel lines spaced apart ½ inch (1.27 cm) between centers of the neighboring ridges.

The grooves 74 and 75 are U-shaped; the sides of walls of the ridges are vertical and smooth; the top of the ridges are rounded and the bottom portion of the ridges meet the upper or top flat surface 17 of the mat 15 at corners with cylindrical surfaces that are concave toward the grooves as 74 and 75 between the ridges. A usual size of the mat is 36 inches (91 cm) long and 18 inches wide but it may be made in other sizes.

This mat has an extremely high electrical resistivity at high voltage which makes it particularly useful as an insulator in oil field use protective equipment for workers.

EMBODIMENT OF FIG. 3

Another embodiment of the mat, shown in FIG. 3, is a layered imperforate, flexible, resilient mat 21; it is composed of (a) a top; carbon black-containing poor electrical insulating layer 22 and (b) a bottom excellent electrical insulating layer free of carbon black which has the same composition and properties as mat 15 and (c) a mesh 27. Layers 21 and 22 and mesh 27 are joined together firmly to provide a total height or thickness 24. The top layer is mechanically strong and the bottom layer is highly electrically insulative and an electrically conductive flexible wire mesh 27 is located between the top and bottom layers 22 and 23. Layers 22 and 23 and wire mesh 27 are oil resistant. The wire mesh is formed of flexible strands of solid cylindrical aluminum wire of 0.2 mm (0.0085 inch) diameter and with parallel strands at 2 mm (0.08 inch) spacing; the mat as 21 is ⅜" (0.95 cm) thick from bottom surface 26 of layer 23 to top flat surface 25 of layer 22, 18¼ inch (46.4 cm) wide and 36½ inches (92.71 cm) long. Layer 23 is ¼ inch (0.64 cm) thick; layer 22 is ⅛ inch (0.32 cm) thick from top of flat surface 25 to top surface of layer 23.

The aluminum wire strands of mesh 27 form an array of square holes between the wires. The wires are firmly imbedded in and attached to the adjacent layers 22 and 23 of rubber-like elastomer and provide mechanical reinforcement thereto.

An oil resistant strong and hard neoprene-(a chloroprene polymer made by E. I. DuPont DeNemours) based elastomer such as in Table II form the upper layer 22. The upper layer 22 may alternatively be an oil-resistant neoprene based elastomer as in Table III which has a high carbon black content. Also, electrically conductive elastomers that are oil-resistant may be used for the upper layer 22.

The upper flat surface 25 of the mat 21 has an array 50 of protuberances or cleats thereon, as 51–56, to improve traction of operators' shoes thereon. Such cleats or protuberances are all of the same size and shape and are evenly spaced in a uniform array over the top surface of the mat. Alternate like cleats as 51 and 53 in each line of cleats are arrayed with their lengths extending in a straight line and other like cleats as 54 and 56, are arrayed in lines parallel to and 2⅜ inch (6 cm) from the line of cleats 51 and 53. Intermediate like cleats as 52 and 55 (and 59) are arranged with their lengths extending in lines of cleats transverse to the line of the cleats as 51 and 53 and as 54 and 56 (or as 52 and 59) and are located with the centers of such intermediate cleats intersecting a line of cleats as 51 and 53 (or as 52 and 58) respectively. The cleats as 51–56 are generally diamond shaped and have a maximum height of 1/16 inch (0.16 cm) at their center and are 1 inch (2.54 cm) long and 7/16 inch wide (1.1 cm) at their center and 3/16 inch (0.48 cm) wide at their ends and have an upper cylindrical surface as 57 and cylindrical-sector shaped sides as 58 of which the straight portions are sloped at angle of 30 degree to flat surface 25 and curved surface 57.

In FIG. 3, cleat 51 is shown in vertical central longitudinal section and cleat 52 is shown in vertical central section transverse to its length.

As the metal mesh 27 is formed of closely spaced wires and those wires are electrically conductive the mesh provides for equalizing the electric potential over the upper surface of the bottom insulating layer 23 of mat 21 and so avoids concentration of electrical stress at any point on the upper surface of layer 23 that might overstress the insulating layer at a small horizontally extending area thereof, while still providing the oil-resistance and toughness of the neoprene layer 22 thereabove.

The particular rubbers used for the upper layer 22 of mat 21 and the like layers in mats 31 and 41 may be substituted for by electrically conductive oil resistant neoprene rubbers. Such neoprene rubbers are taught as comprising different furnace blacks (in Glaister, F. J., Technical Service Report R.G. 128, Boston Mass., Cabot Chemical Corporation) or acetylene black (British Pat. No. 595,745) which with 20 parts loading of carbon black of AS value 26.5 gives a electrical resistivity of order of 10 ohm cm and Shore hardness of 63, as well as channel black (Bulgin D. 1945 (a) Transaction IRI 21 (3) (181–218).

EMBODIMENTS OF FIGS. 4 AND 5

The apparatus 31 as diagrammatically shown in FIG. 4, is an imperforate, flexible, resilient three elastomer layer mat, composed of a top relatively electrically conductive layer, 32, like 22 in thickness, a middle insulating layer, 33 like 23 in thickness, and a bottom conductive layer, 34, like 22 in thickness. The vertical height, 37, extends from a top flat surface, 35, of the mat to its bottom surface, 36. The bottom portion of a top layer, 32, is firmly joined to a top portion of the middle layer, 33, and the bottom portion of the middle layer, 33, is firmly joined to the bottom layer, 34.

An electrically conductive and mechanically reinforcing mesh 39, like mesh 37, is located adjacent and between and attached to the adjacent oil resistant elastomer layers 32 and 33 and a separate electrically conductive mesh 38, like 27, is located adjacent and between and attached firmly to adjacent oil resistant layers 33 and 34 as is mesh 27 in embodiment 21.

FIG. 5 illustrates another embodiment of mat apparatus, 41, a three layer mat. The three layer mat 41 is imperforate, flexible, resilient, and composed of a top insulative layer 42, one half that of layer 23 in thickness, a middle relatively electrically conductive layer 43 like 22 in thickness and a bottom electrically insulating layer 44 one half that of layer 23 in thickness. The bottom portion of the top insulating layer is firmly joined to the top portion of the middle layer 43 and the bottom portion of the middle conductive layer is firmly joined to the top of the bottom insulating layer. The top surface 45 is accordingly mechanically continuous through three layers through the vertical height 47 of the mat to the bottom surface 46 of the mat.

A mesh as 49 like 27 is located between and fixed to adjacent oil resistant elastomer layers 42 and 43 as in mesh 27 in embodiment 21, and a separate mesh 48 like 27 is located between and fixed to adjacent oil resistant elastomer layers 43 and 44 as mesh 27 is attached to adjacent layers in embodiment 21.

Layers 32 and 34 and 43 all are oil resistant elastomers and have compositions as layer 22 of FIG. 3, Layers 33, 42, and 44 are oil resistant elastomers and have compositions like layer 23 of FIG. 3.

TABLE I (1) 1503 type rubber 80 parts, a cold (50° F. and below) polymerized styrene butadiene with a fatty acid emulsifier formed by acid coagulation, 23.5% target bound styrene, with a nominal Mooney viscosity of 52 (ML 1+4) 212° F. and is non staining.

(2) CIS-4-1203 (20 parts) a solution butadiene dry rubber with CIS content of 93% and having a nominal Mooney viscosity (ML 1+4, 100° C.) of 45.

(3) Atomite ($CaCO_3$) 25 parts.

(4) Mineral Rubber (50 parts) (Gilsonite)

(5) Zinc Oxide (10 parts)

(6) Stearic acid (1 part)

(7) Octamine 1 part (an anti oxidant, U.S. trademark registration, 779,286 reaction product of diphenylamine and diisobutylene).

(8) Sunproof wax (2 parts) (a mixture of waxey materials, specific gravity 0.92, melting point 65°–70° C.).

(9) Litharge (PbO) 2 parts.

(10) Zenite—90% of the zinc salt of 2-mercaptobenzo thiazole and 10% hydrocarbon wax—2½ parts.

(11) TMTM (tetramethyl thiuram monosulphide) 2.3 parts.

(12) Sulfur 1.8 parts.

This material has a viscosity (as measured in ASTM D-1646), of 30; this material is compounded at 15 minutes; cured at 307° F. (153° C.); it provides a scorch test of 9.5 minutes at 280° F. (ASTM D-1566).

This material so compounded and vulcanized has a Shore A hardness (ASTM D-2240) hardness of 56.

By ASTM standard 178-77, The standard specification for rubber insulating matting, the d.c. proof test voltage is over 70 thousand volts for this material in form of mat 15. This material has a 300% modulus psi (MPa) 290 (2.0), tensile strength—PSI (MPa) 740 (5.1), elongation 550%, specific gravity 1.13.

TABLE II

Neoprene Layer (1) Neoprene W (polychloroprene) a trademark of E. I. DuPont DeNemours and Co., Mooney viscosity (ML 1+2.5, 212° F.) 50, 100 parts.

(2) Philblack N 110, a trademark of Phillips Petroleum Co., carbon black particle size average mu, 19; surface area average $m^2$/gm 140, DBP 113, 30 parts.

(3) Stearic Acid, 1 part.

(4) Zinc Oxide, 5 parts.

(5) Magnesium Oxide, 4 parts.

(6) Neozone D, phenyl-beta-naphthyl amine (agerite powder) used as anti-oxidant, 2 parts.

(7) Circo Light Oil, Sun Petroleum Products Co. a napthenic oil ASTM D 2226 Type 103, sp. gr. 0.9194, aromatic 42.9%, liq. visc. 156 SUS at 100° F., Flash pt. 330° F., VGC 0.878 aniline pt. 156° F., 4 parts.

(8) Cumar P-25, a coumarone-indene resin, a trademark of Burton Rubber Processing, 4 parts.

(9) Petrolatum, 2 parts.

(10) TMTMS (tetra methylthiuram monosulfide), 0.6 parts.

(11) DPG (accelerator), diphenyl-guanidine, a product of Harwicke Chemical Co., 0.6 parts.

(12) Sulfur, 1 part.

Characteristics of this material are:

Scorch test at 250 deg F. (121 deg C.)+5 . . . 30.0

300% modulus psi (MPA)—[30 minute cure at 370° F. (153° C.)] . . . 1600 (11.0)

Tensile Strength—PSI (MPa) 3680 (25.4)

Elongation %, 530

Shore A Hardness 66

Crescent tear lb/in (kN/m) 260 (45.5)

Crescent tear at 212° F. (100° C.) lb/in (kN/m) 130 (22.75)

Specific Gravity 1.34.

TABLE III (1) NEOPRENE GN 100 parts Mooney Viscosity ML 1+2.5 212 50°-70° F.

(2) Latac ¼ (hexamethylene ammonium hexamethylene dithio carbamate.

(3) Stearic Acid, 1 part.

(4) Neozone D, 2½ parts.

(5) Extra Light Calcined Magnesia, 4 parts.

(6) Thermax 75 parts Carbon Black by Mallinckrodt sp. gr. 1.8, particle size (avg. mu) 320–472, surface area (avg. sq. m./gm.) 8.2, toluene extract 1.0 max., sieve residue 35 mesh 0.001% max. 325 mesh 0.1% max.

(7) Zinc Oxide, 5 parts.

(8) Dibutyl sebacate, 10 parts.

In the multilayered mats as 21, 31 and 41, each of the conductive meshes, as 27, 38, 39, 48 and 49, between the layers of adjacent elastomer do not project or extend outward through the lateral surfaces of such mats but are enclosed within such lateral surfaces usually to a depth relative to such lateral surface which is the same in length as the thickness of the thicker of the two elastomeric layers between which such mesh is located. In the mats, as 21, 31 and 41, the elastomeric layers adjacent each mesh as 27 is of substantially uniform thickness throughout its entire area, except for the cleats on the upper surface of the mat and any like projections on the bottom of such mat.

A purpose of each aluminum (or copper) screen as 27 is to dissipate any static charge that may be built up in the equipment, the operator, or the environs.

By inserting a metal conductor into the mat between the conductive rubbers and non-conductive rubbers in contact with the metal screen as 27, 39, or 48 the static charge may be conducted through the conductive rubber and picked up by the metal screen and dissipated through the metal conductors and wires to grounding poles. The metal may be aluminum and be removable from the screen.

I claim:

1. A protective mat comprising an oil-resistant elastomer with d.c. proof test voltage in excess of 70,000 volts comprising the formulation of 1503 type rubber, a cold polymerized styrene butadiene with a fatty acid emulsifier formed by acid coagulation, 23.5% target bound styrene, with a nominal Mooney viscosity of 52 (ML 1+4) 212° F. and is non staining (80 parts); CIS-4-1203, a solution butadiene dry rubber with CIS content of 93% and having a nominal Mooney viscosity (ML 1+4, 100° C.) of 45 (20 parts); Ca CO3 (25 parts); Mineral Rubber (50 parts); Zinc Oxide (10 parts); Stearic acid (1 part); Octamine (1 part); Sunproof wax (2 parts); PbO (2 parts); 90% of the zinc salt of 2-mercapto-benzo thiazole and 10% hydrocarbon wax (2½ parts); tetramethyl thiuram monosulphide (2.3 parts); and Sulfur (1.8 parts); which material provides a scorch test of 9.5 minutes at 280° F. and has a Shore A hardness of 56.

2. A protective mat comprising a first layer composed of an oil-resistant elastomer with proof test voltage in excess of 70,000 volts in combination with a second, oil-resistant elastomer layer of greater mechanical strength than and of lesser insulating capacity at high voltage than said first layer, said second elastomer layer firmly attached to the top of said first layer, and wherein said first layer comprises a composition composed of 1503 type rubber, a cold polymerized styrene butadiene with a fatty acid emulsifier formed by acid coagulation, 23.5% target bound styrene, with a nominal Mooney viscosity of 52 (ML 1+4) 212 degrees F. and is non staining (80 parts); CIS-4-1203, a solution butadiene dry rubber with CIS content of 93% and having a nominal Mooney viscosity (ML 1+4, 100 degrees C.) of 45 (20 parts); CA CO3 (25 parts); Mineral Rubber (50 parts); Zinc Oxide (10 parts); Stearic acid (1 part); Octamine (1 part); Sunproof wax (2 parts); PbO (2 parts); 90% of the zinc salt of 2-mercapto-benzo thiazole and 10% hydrocarbon wax (2½ parts); tetramethyl thiuram monosulphide (2.3 parts); and Sulfur (1.8 parts); which material is compounded to provide a scorch test of 9.5 min. at 280 degrees F. and has a Shore A hardness of 56;

and said second layer comprises a composition composed of polychloroprene with Mooney viscosity (ML 1+2.5, 212 F.) 50, (100 parts); carbon black, particle size average mu, 19, surface area average $m^2$/gm 140, DBP 113, (30 parts); Stearic Acid, (1 part); Zinc Oxide, (5 parts); Magnesium Oxide, (4 parts); Phenyl-beta- naphthyl amine, (2 parts); a napthenic oil ASTM D 2226 Type 103, sp. gr. 0.9194, aromatic 42.9%, liq. visc. 156 SUS at 100° F. Flash pt. 330° F. VGC 0.878 aniline pt. 156° F., (4 parts); Coumarone indene resin, (4 parts); Petrolatum, (2 parts); Tetra methylthiuram monosulfide, (0.6 parts); Diphenyl-guanidine, (0.6 parts); and Sulfur, (1 part); which material provides a Scorch test (at 250° F. (121° C.)+5), 30.0; Shore A Hardness 66; and Specific Gravity 1.34.

3. A mat as in claim 2 comprising also an electrically conductive metallic mesh between and attached to said first and second layers.

4. A mat as in claim 2 comprising a third, oil-resistant, elastomer layer below and attached to the bottom of said first layer, said third layer having a greater mechanical strength than said first layer.

5. A mat as in claim 4 wherein said third layer is an electrically conductive elastomer.

6. A mat as in claim 4 with an electrically conductive metallic mesh between said first and second layers and a separate electrically conductive mesh between said first and third layers.

7. A mat as in claim 2 comprising a third oil-resistant elastomer layer above and attached to the top of said second layer, said third layer having a dielectric strength at high voltage greater than the elastomer of the second layer.

8. A mat as in claim 7 comprising a conductive metallic mesh between said first layer and said second layer and a separate conductive metallic mesh between said third layer and said second layer.

* * * * *